US010195613B2

(12) United States Patent
Spirovski et al.

(10) Patent No.: US 10,195,613 B2
(45) Date of Patent: Feb. 5, 2019

(54) APPARATUS METHOD AND SYSTEM FOR DISINTEGRATION OF A SOLID

(71) Applicant: Liquitab Systems Limited, Mentone (AU)

(72) Inventors: Tony Spirovski, Blackburn South (AU); Neil George Walker, Deer Park (AU); Julian Meyer, Elanora Heights (AU); David John Bull, Lane Cove (AU)

(73) Assignee: Liquitab Systems Limited, Mentone (AU)

( * ) Notice: Subject to any disclaimer, the term of this patent is extended or adjusted under 35 U.S.C. 154(b) by 477 days.

(21) Appl. No.: 14/432,789

(22) PCT Filed: Oct. 4, 2013

(86) PCT No.: PCT/AU2013/001147

§ 371 (c)(1),
(2) Date: Apr. 1, 2015

(87) PCT Pub. No.: WO2014/056022

PCT Pub. Date: Apr. 17, 2014

(65) Prior Publication Data

US 2015/0246330 A1 Sep. 3, 2015

(30) Foreign Application Priority Data

Oct. 8, 2012 (AU) ..... 2012904390

(51) Int. Cl.
*B02C 19/18* (2006.01)
*B02C 25/00* (2006.01)
(Continued)

(52) U.S. Cl.
CPC ..... *B02C 19/18* (2013.01); *B01F 3/1235* (2013.01); *B01F 11/02* (2013.01);
(Continued)

(58) Field of Classification Search
CPC ..... B02C 19/18; B02C 25/00; B01F 11/02; B01F 11/0291; B01F 3/1235
(Continued)

(56) References Cited

U.S. PATENT DOCUMENTS 4,697,751 A * 10/1987 Chiba ..... B02C 19/18 241/1
4,779,806 A * 10/1988 Langer ..... A61K 9/0009 222/1
(Continued)

FOREIGN PATENT DOCUMENTS

WO 88/06927 9/1988
WO 97/02088 1/1997
(Continued)

OTHER PUBLICATIONS

The International Search Report and Written Opinion dated Nov. 26, 2013, in PCT/AU2013/001147 filed Oct. 4, 2013.

*Primary Examiner* — Faye Francis
(74) *Attorney, Agent, or Firm* — Hovey Williams LLP

(57) ABSTRACT

An apparatus for disintegration (or mixing) of a solid in a receptacle containing liquid, has a control unit and an ultrasound transducer generating ultrasonic energy under control of the control unit. An annular coupling element in communication with the ultrasound transducer is adapted to receive the receptacle. Ultrasonic energy is transferred to the receptacle contents through the annular coupling element. In use, the ultrasonic energy transferred to the receptacle contents causes disintegration of the solid into the liquid. A method for disintegration of a solid in a receptacle is also described.

17 Claims, 7 Drawing Sheets

(51) Int. Cl.
*B01F 11/02* (2006.01)
*B01F 3/12* (2006.01)

(52) U.S. Cl.
CPC ..... *B01F 11/0266* (2013.01); *B01F 11/0291* (2013.01); *B02C 25/00* (2013.01)

(58) Field of Classification Search
USPC ..... 241/1, 301
See application file for complete search history.

(56) References Cited

U.S. PATENT DOCUMENTS 4,874,137 A * 10/1989 Chiba ..... C12N 1/066 241/1
7,857,243 B2 * 12/2010 Li ..... B02C 19/18 241/1
2004/0191275 A1 * 9/2004 Milner ..... B01F 1/0005 424/400
2008/0308404 A1 * 12/2008 Luotola ..... B01F 11/0005 204/157.15
2009/0052272 A1 2/2009 Sarvazyan
2010/0008178 A1 1/2010 Fahrion
2011/0101136 A1 * 5/2011 Rothmann ..... C12N 1/066 241/1
2013/0087445 A1 * 4/2013 Luotola ..... B01F 11/0266 204/157.15
2016/0082402 A1 * 3/2016 Kitada ..... B01F 3/1242 241/1

FOREIGN PATENT DOCUMENTS

WO 2002013754 2/2002
WO 2006119932 11/2006

* cited by examiner

APPARATUS METHOD AND SYSTEM FOR DISINTEGRATION OF A SOLID

RELATED APPLICATIONS

This is a national stage application under 35 U.S.C. § 371 of International Application No. PCT/AU2013/001147, filed Oct. 4, 2013, which claims the priority of Australian Patent Application No. 2012904390, filed Oct. 8, 2012. The disclosures of the above-referenced applications are hereby incorporated into the present application by reference in their entireties.

FIELD OF THE INVENTION

The invention relates to apparatus for disintegration or dispersion of a solid in a liquid using ultrasound energy and a method and system for the same. It relates particularly but not exclusively to disintegration of a solid being a pharmaceutical composition or medication in the form of a tablet, pill, capsule, caplet or the like for dissolving, dispersing, suspending, emulsifying or otherwise working into a fluid for consumption by drinking.

BACKGROUND TO THE INVENTION

A preferred method for administering medication orally is by consumption of a solid form of medication such as a tablet, pill, capsule, caplet or the like. Providing medication in tablet form utilises inexpensive production techniques, cheaper packaging and provides a relatively long shelf life for the medication. A further advantage is that each tablet contains a known dosage of the medication which can be dispensed in unitary fashion from a bottle, blister pack or other packaging immediately prior to consumption. Where tablets are contained in a blister pack, unitary dispensing of each tablet dosage prevents oxidation or contamination of the remaining dosages. In contrast, liquid formulations typically have a short shelf life and each dose requires individual measuring.

There are, however, problems associated with administering medication in tablet form. A large proportion of the population experiences difficulty swallowing tablets. This syndrome is known as dysphagia and is associated with taking certain forms of oral medication, particularly tablets. In some cases, tablets are particularly large and are difficult to swallow. For many patients, swallowing tablets can elicit a gag reflex. Other patients such as the mentally ill, the elderly and small children are simply unable to swallow solid medication. This problem is also experienced by patients who are unconscious and patients who use a feeding tube.

Historically, problems associated with swallowing whole tablets have been addressed by mechanical crushing of the solid medication. There are various ways to perform mechanical crushing of medication in solid form. One approach involves use of a mortar and pestle to break up the tablet for dissolution or suspension in a liquid. Other approaches involve placing the tablet inside a plastic envelope or sheath and hammering the sheath to break the tablet into small particles. These particles are then collected and worked into jam or other food to be consumed by the patient.

Drawbacks of these methods include inconsistent particle size and a risk of cross-contamination between medications. Although the devices can be cleaned between uses, this adds considerably to the time required to prepare and administer the medication and there is a risk that cleaning will not be performed as regularly or as thoroughly as needed. Furthermore, there is a risk that a recipient may receive a medication dosage which is less than the entire tablet, since residual tablet particles are typically left behind in the crushing device. In addition, nurses and carers operating these mechanical crushing devices may become exposed to the medication when in powdered form by inhaling or manual contact which has obvious health implications.

In view of these drawbacks, it would be desirable to provide an alternate approach for disintegrating medication in solid form for consumption, e.g. in a liquid.

SUMMARY OF THE INVENTION

Viewed from one aspect, the present invention provides apparatus for disintegration of a solid in a receptacle containing liquid, the apparatus including a housing containing:

(a) a control unit;

(b) an ultrasound transducer generating ultrasonic energy under control of the control unit; and (c) an annular coupling element in communication with the ultrasound transducer and adapted to receive the receptacle and through which ultrasonic energy is transferred to the receptacle contents;

wherein in use, the ultrasonic energy transferred to the receptacle contents causes disintegration of the solid into the liquid.

The annular coupling element is preferably a ring sonotrode in the form of a circular collar having an average circumference equivalent to about one wavelength of the ultrasonic energy generated by the transducer. However the sonotrode may take various forms such as oval, rectangular, hexagonal, octagonal or the like.

The control unit may determine automatically an optimal frequency for disintegration of the solid and control the ultrasound transducer to generate ultrasonic energy at the optimal frequency. In one embodiment, the control unit controls the ultrasound transducer to operate in a swept frequency mode in which ultrasonic energy frequency fluctuates between a resonant frequency and one or more non-resonant frequencies. The resonant frequency may be about 42 kHz and the non-resonant frequencies may be about ±2 kHz relative to the resonant frequency. When operated in swept frequency mode, frequency sweeping may be cyclical and or randomly determined and or dynamically controlled by the control unit e.g. based one or more sensor inputs.

In one embodiment, the annular coupling element has a cross-sectional profile configured to maximise ultrasonic energy transference to the receptacle contents. Thus, an internal surface of the annular coupling element may be contoured with a first taper toward a first edge of the annulus into which the receptacle is received. The internal surface of the annular coupling element may have a second taper toward a second edge of the annulus which opposes the first edge of the annulus. The second taper may assist with balance of the annular coupling element during use. Preferably the annular coupling element includes a contact region adapted to contact an external wall of the receptacle and through which the ultrasonic energy is transferred to the receptacle and its contents. Application of the ultrasonic energy to the annular coupling element may cause the element to distort in one or more modes of distortion such as radial and torsional distortion.

In one embodiment, the apparatus includes a force actuator adapted to apply a force, preferably a downward force, to the receptacle to enhance coupling between the receptacle and the annular coupling element. The force actuator may be incorporated into a cover member for closing an opening in the housing into which the receptacle is received. The cover member may be operable from an open configuration to a closed configuration in a manner which maintains alignment of the receptacle within the annular coupling element. This may involve a hinge or other closure mechanism operating in two stages.

The apparatus may include a waste in the housing for egress of unwanted fluid from the apparatus. It may further include cooling means for maintaining the apparatus and/or the receptacle contents in an acceptable temperature range during operation of the apparatus.

Another aspect of the invention provides a receptacle for use with the inventive apparatus. The receptacle includes an external wall profile configured to engage a contact region on an internal surface of the annular coupling element to maximise ultrasonic energy transference to the receptacle and its contents. The receptacle may also have a marking to indicate a fill level which is desirable or recommended for a liquid added to the receptacle before operation of the apparatus. Such volume may be e.g. 40 ml to 60 ml. Preferably, the receptacle is provided with a lid for sealingly closing the receptacle.

Viewed from another aspect, the present invention provides a method for disintegrating a solid in a receptacle including the steps of:

(a) providing a volume of liquid together with the solid in the receptacle;
(b) loading the receptacle containing the solid and liquid into an annular coupling element coupling the receptacle to an ultrasonic energy source; and
(c) activating the ultrasonic energy source to apply ultrasonic energy to the annular coupling element for a time sufficient to cause disintegration of the solid in the receptacle.

Preferably, the ultrasonic vibrations achieve disintegration of the solid in less than 10 minutes, more preferably less than 6 minutes, more preferably still less than 3 minutes. The ultrasonic energy frequency may fluctuate between a resonant frequency and one or more non-resonant frequencies. The resonant frequency may be e.g. about 42 kHz and the non-resonant frequencies may be about ±2 kHz relative to the resonant frequency.

In one embodiment, the method involves application of a coupling force to the receptacle in a direction toward the annular coupling element to enhance coupling between the receptacle and the annular coupling element and hence transfer of ultrasonic energy into the receptacle contents.

In one embodiment, the method includes providing e.g. an audible and or a visible cue to indicate that the solid in the receptacle has been disintegrated within the liquid and is ready for consumption. Where the solid being disintegrated is a medical preparation such as a tablet, pill, capsule or caplet, the method may further include the step of providing an audible and or visible cue to indicate that a medication dosage is due.

In one embodiment the method also involves adding a flavouring to the liquid. The flavouring may be provided in e.g. liquid or powdered form or may be a flavouring pellet which is disintegrated within the receptacle together with the target solid. It may also be desirable to activate a cooling unit during disintegration to cool the apparatus and or the receptacle contents as prolonged treatment with ultrasound energy can cause heating of the liquid to a temperature which is too hot for immediate consumption.

Viewed from another aspect, the present invention provides apparatus for mixing a liquid e.g. containing solid particles and contained in a receptacle, the apparatus including a housing containing:

a control unit;

an ultrasound transducer generating ultrasonic energy under control of the control unit;

an annular coupling element in communication with the ultrasound transducer and adapted to receive the receptacle for transfer of the ultrasonic energy to the receptacle contents;

wherein in use, the control unit controls the ultrasound transducer to generate ultrasonic energy which varies between a first and second frequency causing mixing of the receptacle contents.

Preferably the first frequency is a resonant frequency and the second frequency is a non-resonant frequency. Variation between the first and second frequencies may be cyclical or random. In one embodiment, the apparatus includes one or more sensors for determining a state of agitation of the receptacle contents. The sensors provide one or more signals to the control unit for controlling operation of the ultrasound transducer. Thus, variation between the first and second frequencies may be dynamically determined by the control unit based on signals from the one or more sensors.

Viewed from yet another aspect, the present invention provides a method for mixing a liquid including the steps of:

providing a volume of liquid to be mixed in a receptacle;

loading the receptacle into an annular coupling element which is coupled to an ultrasonic energy source; and activating the ultrasonic energy source to generate ultrasonic vibrations coupled to the receptacle contents by the annular coupling element;

wherein the ultrasonic energy vibrations mix the receptacle contents.

In one embodiment the receptacle contains or more solids or particles to be mixed into the liquid, or different liquids to be mixed.

BRIEF DESCRIPTION OF THE DRAWINGS

The invention will now be described with reference to the embodiments illustrated in the accompanying drawings. It is to be understood that the embodiments illustrated are provided by way of example only. The particularity of these embodiments does not supersede the generality of the preceding parts of the description.

DETAILED DESCRIPTION

Throughout this description, the term "tablet" will be used to describe any solid form of medication or pharmaceutical preparation provided in tablet, pill, capsule, caplet or other such like form which is amenable to disintegration. Although some such tablets have coatings or layered formulations for slow release of active constituents, the method and apparatus of the invention may still be useful for disintegration of the tablet into a form which can be dispersed, suspended, dissolved, emulsified or otherwise combined into a liquid for oral consumption.

Although the inventive apparatus and method are herein described in the context of disintegration of a solid form of medicament, it is to be understood that the invention and the claims appended hereto are not to be so limited. The invention has applicability in the disintegration of non-medicament solids and/or mixing of liquids and or solids/particles in a liquid.

Figure 1:
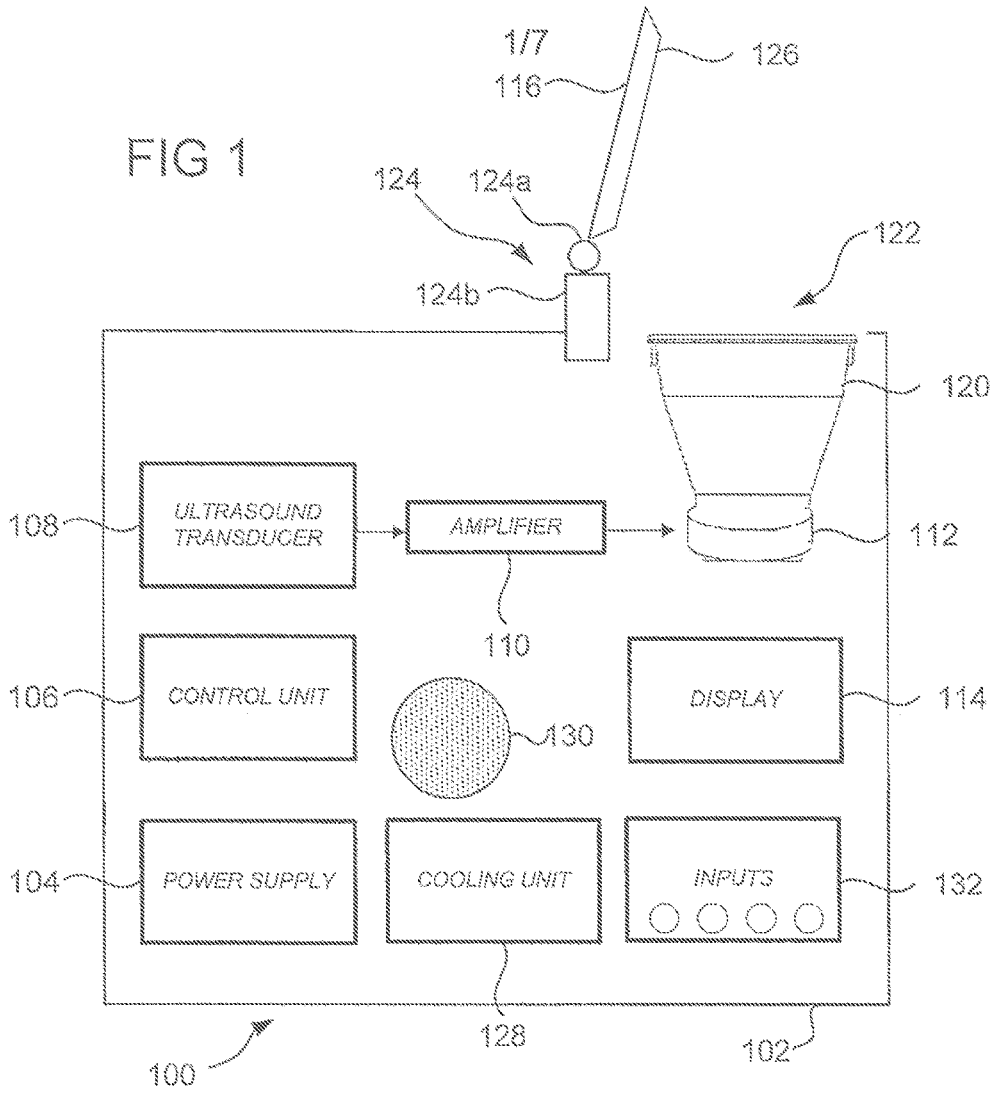
FIG. 1 is a simplified block diagram showing apparatus according to an embodiment of the invention.

Referring firstly to FIG. 1 there is shown a simplified block diagram of apparatus 100 for disintegration of a solid, such as a solid medication in the form of a tablet, according to an embodiment of the invention. The apparatus has a housing 102 which is preferably manufactured from durable plastics or other material which can be wiped over with a cloth and which can be manufactured and shipped in a cost effective manner. Although the housing has little involvement with the functionality of the apparatus (with the exception of the cover member discussed below), it is desirable for the apparatus housing to be designed with usability in mind. Thus it may be desirable for the housing to have attractive appearance akin to general household appliances, rather than devices used in the medical setting.

The housing 102 has an opening 122 into which a receptacle 120 containing a tablet and liquid may be received. A cover member 116 is provided to close the apparatus opening during use so that the receptacle is not inadvertently removed before the disintegration process has concluded and to avoid accidental spillage or contamination. Preferably, receptacle 120 is fitted with a sealing lid prior to being inserted into the apparatus to limit the risk of liquid being spilled from inside the receptacle and concomitant loss of medication. After the tablet has been disintegrated, the receptacle is removed from the apparatus, the lid is removed from the receptacle and the content, which includes the disintegrated tablet, is consumed by drinking.

Inside housing 102 is a power supply 104 and control unit 106. The power supply may be coupled with an external AC power source and regulates the power to provide voltage as needed to the control unit 106, ultrasonic transducer 108, display 114 and other powered components in the apparatus. Preferably, the power supply 104 includes an auto-regulating supply to provide the minimum power required to maintain the ultrasonic vibrations generated by the transducer 108 at the amplitude specified by the control unit 106.

Control unit 106 is operably coupled to the ultrasound transducer 108 and other components such as display 114 and cover member actuator 124, each of which may be controlled by an electronic signal. The control unit 106 comprises control electronics preferably embodied in firmware written to read only memory (ROM) or programmable ROM (PROM) of a microprocessor as is known in the art, although it is to be understood that the control electronics may alternatively be provided on a stand alone computer or other memory-processor device operably connected to the apparatus and its components.

The ultrasound transducer 108 generates ultrasonic energy under the control of the control unit 106 and is coupled to annular coupling element 112 (hereinafter referred to as sonotrode 112) via amplifier 110. Amplifier 110 amplifies the ultrasound signal from transducer 108 to an intensity sufficient to cause disintegration of a tablet in the receptacle within a reasonable time frame.

Amplification may be by a factor of e.g. 10 or more where a low intensity ultrasound signal is emitted from the transducer. Preferably, the acousto-mechanical amplification required is less than ×10, and more preferably, less than ×5 so that the amplifying element, whose geometry is dictated by the amount of amplification, can be accommodated in an apparatus for use on a bench top or trolley. For a standard 50 W transducer, an amplification factor of about 3 has been found sufficient as this gives rise to disintegration times of less than about 6 minutes for a range of different tablet types. Preferably, the time required to achieve disintegration is less than 10 minutes and more preferably less than 6 minutes. A disintegration time of about 3 to 6 minutes may be acceptable in many settings although a disintegration time of one minute or less may be desirable e.g. for high throughput apparatus. Shorter disintegration times may be achieved by using a higher intensity/higher amplitude ultrasound signal.

The ultrasound transducer may be of any type although a piezoelectric transducer is preferred, having a resonant frequency greater than 20 kHz which is accepted to be the upper limit of human hearing. In one embodiment, the ultrasound transducer has a resonant frequency of about 40 kHz although such frequency is not to be taken as prescriptive; transducers having different operational ranges may be utilised and the design of other components such as the amplifier and sonotrode may be modified as discussed herein to achieve tablet disintegration in the desired time.

Resonant frequencies in the range 20-45 kHz may be used. However, as the resonant frequency approaches the lower limit of this range, the likelihood of human awareness of the ultrasonic signal increases. Thus, use of the apparatus at lower frequencies may cause irritation to people in the vicinity of the apparatus when in use. In addition, in a preferred embodiment the sonotrode has a circumference equivalent to about one wavelength of the energy generated by the ultrasound transducer (at resonance). Since wavelength is inversely proportional to frequency, decreasing the resonant frequency will increase the required sonotrode diameter for a given sonotrode material.

The sonotrode ring is configured to receive a receptacle containing the solid to be disintegrated. The ultrasonic energy is coupled, through the sonotrode and receptacle wall, to the receptacle contents. Since the receptacle sits inside the sonotrode ring to achieve this coupling, a large sonotrode ring diameter will require a receptacle or a cup that may be too large for many users to handle. Moreover, an overly large sonotrode ring will in turn require an unacceptably large apparatus which will limit appeal to end users.

Conversely, increasing the ultrasound frequency will produce a decrease in sonotrode diameter which will, in turn, require a decrease in the diameter of the receptacle at least at the region which fits into and couples with the sonotrode ring. This has implications for receptacle usability (a cup which is too small can be just as difficult to handle and drink from as a cup which is too large) and also for receiving an acceptable volume of liquid. Thus, embodiments of the present invention have adopted a trade off where a readily available ultrasound transducer able to produce a resonant frequency of about 42 kHz has been selected.

Alternatively or additionally, the ultrasound transducer may be amenable to operating at a range of frequencies, and the operating frequency may be controlled by control unit 106, based on the resonant frequency of the system including the receptacle and its contents when placed in the sonotrode. Thus, the control unit may determine automatically an optimal frequency for disintegration of a solid within the receptacle, and control the ultrasound transducer to generate the ultrasonic energy at the optimal frequency. Such an arrangement involves feedback control electronics which may monitor e.g. the current being drawn as an indicator of whether or not the system is operating at resonance. Other methods for determining resonance of the system and/or matching the operating frequency of the ultrasound transducer to the system may be utilised, as would be understood by a person of ordinary skill in the art.

In one embodiment, the ultrasound transducer operates in a simple mode, generating energy at about the resonant frequency. The ultrasonic signal is coupled, through amplifier 110 and sonotrode 112, to the receptacle and its contents comprising one or more medication tablets together with a liquid such as water. Unless the particles in the tablet are held together very firmly they will tend to separate due the immense accelerations generated by the high pressure changes caused by the ultrasonic vibrations.

During testing of the invention, it has been discovered that particulate matter which forms as the tablet disintegrates can tend to group together inside the receptacle, most notably in the crease where the receptacle wall meets the receptacle floor. This is undesirable since reflective and diffractive losses can occur thereby limiting the efficiency of continued ultrasonic treatment (sonication) by the apparatus. Furthermore, when the disintegration process is complete it can become difficult to dislodge the particles from the receptacle when the contents are consumed orally.

Figure 6A:
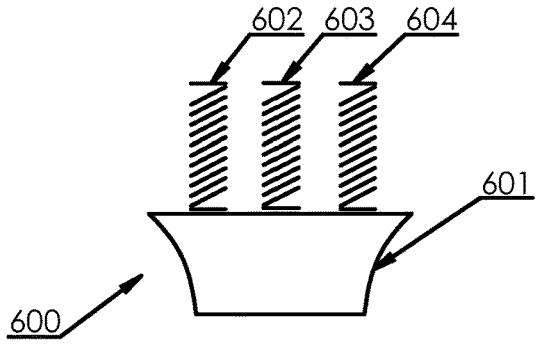
FIG. 6*a* is a side view of a receptacle securing device.
Figure 6B:
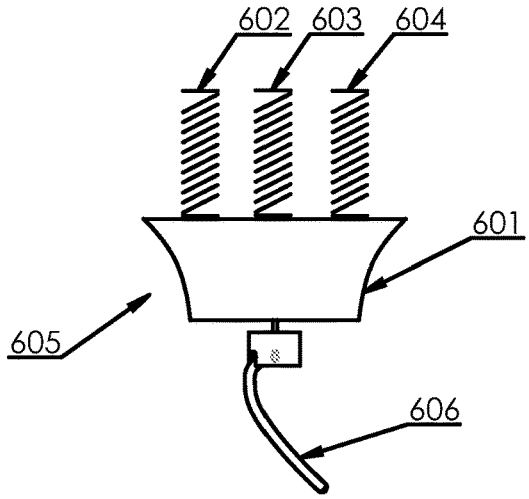
FIGS. 6*b* and 6*c* are side and perspective views of a receptacle securing device with stirrer.
Figure 6C:
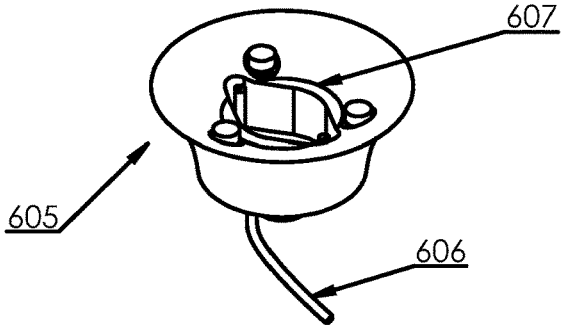

To address this problem, it may desirable to agitate the contents of the receptacle such that they become properly dispersed within the liquid or at least removed from the crease area. Agitation may occur by any suitable means. In one embodiment a mechanical agitator may be associated with cover member 116. The mechanical agitator may include a steel hook driven via a stepper motor as shown in FIGS. 6*b* and 6*c*.

Figure 2:
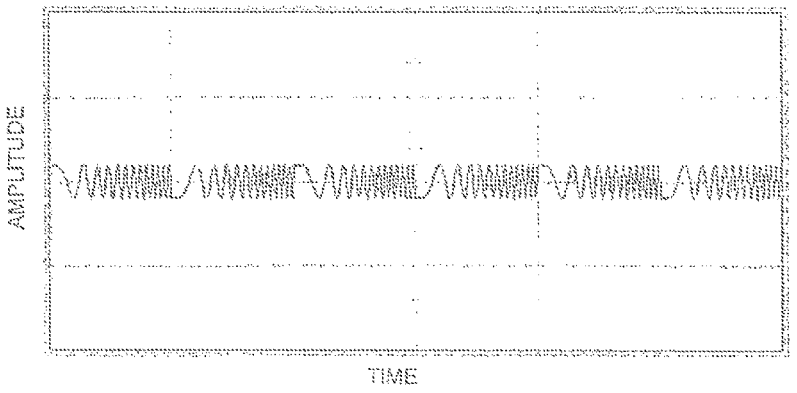
FIG. 2 is a graph of an ultrasonic energy signal in swept mode, according to an embodiment of the invention.

In another embodiment, agitation of the receptacle contents may be achieved by operating the ultrasound transducer in a swept frequency mode. FIG. 2 is a graph representing a driving signal as may be applied to the ultrasound transducer in swept frequency mode, according to an embodiment of the invention. In swept frequency mode the signal driving the ultrasound transducer and hence the ultrasonic energy emitted from the transducer fluctuates between the resonant frequency and a non-resonant frequency. In one embodiment, swept frequency mode operation involves fluctuations between the resonant frequency and a non-resonant frequency either side of the resonant frequency. The non-resonant frequency may be e.g. ±0.1%, ±0.5%, ±1%, ±2%, ±3%, ±5% or even ±10% of the resonant frequency. Experimental data suggests that for a transducer resonant frequency of about 42 kHz, the non-resonant end point frequencies employed in swept frequency mode may be approximately 5% or 2 kHz either side of the resonant frequency such that the ultrasonic frequency signal emitted by the transducer oscillates between about 40 kHz and 44 kHz.

During swept frequency operation, the control unit controls the drive frequency applied to the ultrasound transducer to increase and decrease around the resonant frequency. Sweeping of frequencies may occur at any rate. In one embodiment, the sweep cycle is approximately 0.3 to 2 Hz such that the frequency sweeps between resonance and a predetermined non-resonant frequency every 0.5 seconds to every 2 or 3 seconds although longer or shorter sweep cycles may be implemented. Frequency sweeping may be cyclical or random, or may be adjusted dynamically and preferably automatically by the control unit according sensor inputs providing feedback to the control unit indicating the extent to which particles disintegrated from the solid require further agitation within the receptacle.

As the drive signal frequency approaches the resonant frequency, the amplitude of ultrasound vibrations increases. At the resonant frequency, the system behaves in resonance mode applying maximum amplitude ultrasonic vibrations to the receptacle. As the drive signal frequency is further increased, the system moves past its resonance point and the amplitude of ultrasound vibrations decreases.

The control unit may be configured with a predetermined upper limit (e.g. the maximum frequency) for a drive signal. Once the drive signal frequency reaches the predetermined upper limit the control unit will begin to decrease the drive signal frequency. As the decreasing drive signal frequency approaches the resonant frequency the amplitude of ultrasound vibrations will again increase until the system is operating in resonance mode.

Preferably, the control unit further decreases the drive signal frequency. As the drive signal frequency is decreased below resonance, the amplitude of ultrasound vibrations decreases again. The control unit may be configured with a predetermined lower limit (i.e. minimum operational frequency) for a drive signal. Once the drive signal frequency reaches the predetermined lower limit the control unit will begin to increase the drive signal frequency. As the increasing drive signal frequency approaches the resonant frequency the amplitude of ultrasound vibrations will again increase until the system is operating in resonance mode. The sweeping of driving signal frequencies between resonance and one or more predefined non-resonance frequencies continues.

Operating the apparatus in swept frequency mode agitates the receptacle contents and decreases the extent to which disintegrated particles group together in the receptacle. This can improve the efficiency with which the solid is disintegrated.

Preferably, the apparatus 100 includes a force actuator 126 which applies a force to the receptacle 120 when loaded in the sonotrode to enhance coupling between the sonotrode and the receptacle wall. This in turn maximises ultrasonic energy transference to the receptacle contents. In the embodiment illustrated in FIG. 1, the force actuator 126 is contained within a cover member 116 for closing the opening 122 in housing 102 although any actuator applying a coupling force between the receptacle and the sonotrode may be utilised.

In the illustrated arrangement, the force actuator includes an internally sprung membrane applying a downward force of approximately 800 to 1,000 grams through the receptacle when the cover member is in the closed position. The force actuator limits the extent to which the receptacle hovers or moves within the sonotrode during operation. Applying a greater downward force into the ring will improve coupling (i.e. energy transfer into the receptacle) until damping occurs. A downward force greater than 1,000 g could be used to improve coupling although this may negatively impact overall design. For example, for downward forces greater than 1000 grams in embodiments where a mechanical (e.g. spring loaded) actuator is used to release the cover member, design and operation becomes complex.

Preferably, the cover member 116 including force actuator 126 is operable from an open configuration (FIG. 1) to a closed configuration (not shown) in two stages so as to maintain alignment of the receptacle within the sonotrode particularly during application of the coupling force. In one embodiment, cover member 116 utilises a two-stage actuator 124 during closure. In one stage, cover member 116 pivots around a hinge 124*a*; in another stage, cover member 116 is lowered into opening 122 via a vertical actuator 124*b*. Vertical actuator 124*b* may be provided by resilient, pneumatic, hydraulic, electronic or other means and may operate manually via mechanical means or automatically, under control of control unit 106 to open and close the cover member. It is to be understood that a range of different closure arrangements may be provided which facilitate closure of the apparatus opening 122 while maintaining alignment of the receptacle within the sonotrode. One arrangement may include a receptacle securing device as shown in FIG. 6*a* including a flared body adapted to be received in the mouth of the receptacle. The flared body may provide better lateral alignment of the receptacle within the sonotrode. The flared body may also include springs as shown in FIGS. 6*a* and 6*b* to provide additional downward force to the receptacle 120. Another arrangement may involve a sliding closure in combination with vertical actuator 124*b*.

Display 114 may be provided to convey information to a user of the apparatus. The display may be a simple LED or LED array configured to illuminate in a particular colour scheme or pattern to indicate when the apparatus is in use and/or when the disintegration process is complete (i.e. the tablet has been disintegrated into the liquid in the receptacle and is ready for oral consumption). In a more sophisticated embodiment, the display may incorporate an LED or LCD screen controlled by control unit 106 to present a user with information such as time remaining until disintegration is complete and, where the control unit has been pre-programmed with personalised medication data, to present a user with information pertaining to relevant dosage regimes, the time and date and other useful information.

Where the apparatus is intended for use in the home the control unit may be connected with a remote monitoring station via a local area network (LAN) or wide area network (WAN), telephone line, wireless network or the like. Such connection may be used to communicate compliance information to a remote station as may be located e.g. with a general medical practitioner, nurse or monitoring service, to supervise a user's compliance with prescribed medication regimes.

The apparatus may also be fitted with a loudspeaker 130 operated under control of control unit 106 to give audible alerts to a user to indicate when the disintegration process is complete. The speaker may also be operable to provide an audible alert to indicate when a medication dosage is due. The audible alert may be in the form of an alarm, beep, chime or synthesised or pre-recorded voice message.

In a preferred embodiment the apparatus also includes inputs 132 operable by a user to input data to the control unit. Inputs may be in the form of buttons, a keypad or a touch-screen incorporated into display 114. Inputs 132 may also include a USB or memory card slot so that control unit 106 may receive personalised medication regime information and/or software and system upgrades.

A cooling unit 128 may be provided to maintain an acceptable temperature within the receptacle. This may be particularly useful where high intensity ultrasonic energy is applied to minimise the disintegration time, or where disintegration times are long and cause the contents of the receptacle to approach the limit of acceptable heating. The cooling unit may also cool the apparatus itself e.g. by way of a fan. The cooling unit may be thermostatically controlled or may operate according to signals from control unit 106.

Figure 3A:
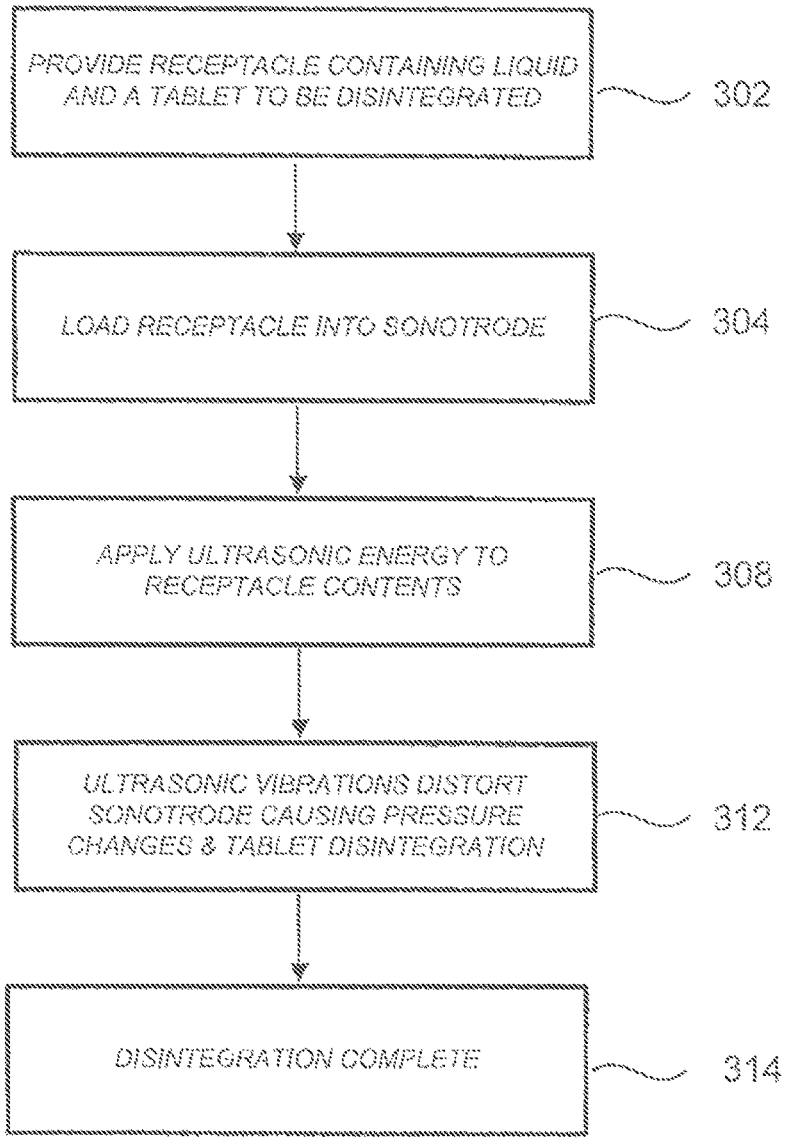
FIG. 3*a* is flow diagram showing steps in a method of disintegrating a solid form of medication according to an embodiment of the invention.

Referring now to FIG. 3*a*, a flowchart illustrates steps in a method 300 of disintegrating a solid medication or pharmaceutical substance in the form of a tablet according to an embodiment of the invention. In a step 302 a receptacle is provided containing volume of liquid and a tablet to be disintegrated. A volume of around 40 ml is useful for disintegration of most tablet types although initial testing indicates that a larger liquid volume (e.g. 60 ml) may be required as more tablets are placed inside the receptacle for disintegration.

More than one tablet may be disintegrated in the receptacle simultaneously, although this may require higher intensity treatment and/or longer sonication times (and larger liquid volumes as discussed above) to achieve adequate disintegration of the tablets. In a step 304 the receptacle containing the liquid and the tablet is loaded into the annular coupling element (sonotrode) inside the apparatus and in a step 308, ultrasonic energy generated by the ultrasound transducer is applied through the receptacle wall to its contents. The ultrasonic vibrations distort the sonotrode causing pressure changes inside the receptacle and disintegration of the tablet into particles (step 312). The disintegration process concludes (step 314) when the ultrasound transducer ceases operation.

Figure 3B:
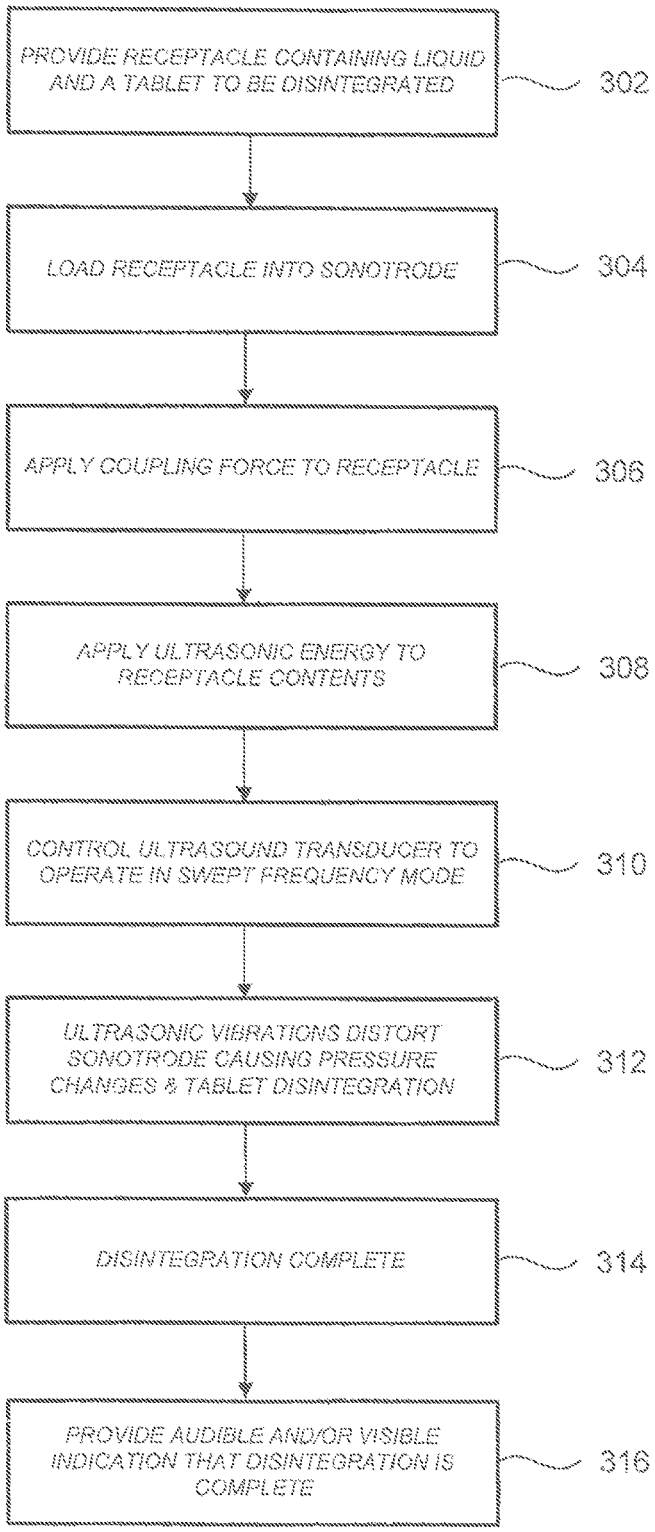
FIG. 3*b* is a flow diagram showing steps in a method of disintegrating a solid form of medication according to another embodiment of the invention.

FIG. 3*b* is a flow chart illustrating the method of FIG. 3*a* with additional steps that may be performed in another embodiment of the invention. Here, in a step 306 a coupling force is applied to the receptacle, urging the receptacle into the sonotrode ring to minimise movement during operation thereby maximising ultrasonic energy transference to the receptacle contents. The coupling force may be about 800 to 1,000 grams downward force and may be applied by a sprung interior membrane of a cover member which covers the receptacle when loaded in the apparatus. Preferably, the receptacle is sealed closed with a removable lid prior to being loaded into the sonotrode. Thus, the coupling force may be applied through the lid and/or through the rim of the receptacle opening. In a preferred embodiment, the control unit controls operation of the ultrasound transducer to operate in swept frequency mode (step 310) to minimise the likelihood of disintegrated particles grouping together inside the receptacle.

TABLE 1

| | Cycle Time | | |
|---|---|---|---|
| Product | 3.5 minutes | 4.5 minutes | 6.5 minutes |
| Diabex Tablet 500 mg | Dispersed | | |
| Losec Tablet 20 mg | Dispersed | | |
| Panadeine Forte Tablet | 50% Dispersed | 60% Dispersed | Dispersed |
| Valium Tablet 5 mg | Dispersed | | |
| Coversyl Plus Tablet 5.1.25 mg | Dispersed | | |
| Maxolon Tablet 10 mg | Dispersed | | |
| Stemetil Tablet 5 mg | Dispersed | | |

TABLE 1-continued

| Product | Cycle Time 3.5 minutes | 4.5 minutes | 6.5 minutes |
|---|---|---|---|
| Zocor Tablet 40 mg | 60% Dispersed | Dispersed | |
| Tenormin Tablet 50 mg | Dispersed | | |
| Motilium Tablet 10 mg | Dispersed | | |
| Karvezide Tablet 300/12.5 mg | 50% Dispersed | 80% Dispersed | Dispersed |
| Rulide Tablet 150 mg | Dispersed | | |
| Plavix Tablets 75 mg | 60% Dispersed | Dispersed | |
| Panamax Tablets 500 mg × 2 | Dispersed | | |
| Nurofen Caplets 200 mg | Dispersed | | |
| Lipitor Tablet 20 mg | Dispersed | | |

Table 1 above provides results from use of the apparatus, according to an embodiment of the invention, for disintegration of a variety of solid medications types in a liquid volume of 40 ml. Disintegration and satisfactory dispersion of the disintegrated medication within the liquid was achieved in around 3.5 minutes for most medications. All of the medication types tested were disintegrated and dispersed within the liquid in less than 6.5 minutes.

In some embodiments, it may be desirable to use water as the liquid into which the solid is disintegrated and becomes dispersed, dissolved or emulsified. However, many forms of solid medication have a taste which is unpleasant. Accordingly, it may be desirable to use a flavoured liquid as the dispersion medium in order to mask or at least improve the taste of the liquid. Alternatively, a flavoured powder, liquid or other form of additive may be added to the receptacle to mask the unpleasant taste of some medications. Where a flavouring pellet is used, this may be placed in the receptacle, along with the solid medication to be disintegrated, prior to sonication. This ensures that the flavour pellet is adequately dissolved or dispersed into the liquid, together with the medication.

The ultrasound transducer is operated under control of control unit 106 which may be pre-programmed to operate the transducer for a fixed duration. This duration may be set in firmware according to the type of tablet to be disintegrated. In one embodiment, the control unit may be pre-programmed with a range of disintegration times required for disintegration of various tablet types. A user may use inputs 132 to select the tablet type to be disintegrated before loading the receptacle containing the tablet into the sonotrode and closing the cover member 116. The control unit then controls the ultrasound transducer to deliver the ultrasonic energy for the pre-programmed duration required for that tablet.

Alternatively, the control unit may determine automatically the time required to disintegrate a tablet in the receptacle. The control unit may also determine automatically the optimal frequency for disintegration of the tablet and optionally, cause the transducer to operate in swept frequency mode.

In a preferred embodiment, apparatus 100 includes one or more optical sensors, accelerometers or the like for detecting the condition of the receptacle contents and specifically, the degree to which the solid has been disintegrated and or dispersed. The sensors provide a feedback signal to control unit 106 which is in turn used to control operation of the ultrasound transducer 108. When the sensor signals indicate that the receptacle contents are sufficiently disintegrated (e.g. to a particle size able to be passed through a No. 10 mesh sieve), then the control unit automatically stops operation of the ultrasound transducer.

Alternatively/additionally the sensors may provide a feedback signal to control unit 106 which indicate the extent to which the particles in the receptacle have been mixed. When the sensor signals indicate that the receptacle contents require further mixing (e.g. the suspension is inconsistent) the control unit will operate the ultrasound transducer in swept frequency mode for further agitation of the receptacle contents. When the sensor signals indicate that there has been adequate mixing the control unit 106 automatically stops operation of the ultrasound transducer in swept frequency mode and may stop operation of the ultrasound transducer altogether.

In a preferred embodiment, when disintegration of the tablet is complete (step 314) the control unit operates loudspeaker 130 to provide an audible alert to a user (step 316) to indicate that the tablet has been disintegrated and is ready for oral consumption by drinking the liquid contents of the receptacle. The audible alert may be in the form of an alarm, beep, chime or synthesised or pre-recorded voice message. Alternatively or additionally, the control unit may operate display 114 to provide a visible cue at completion of the disintegration process.

Figure 3C:
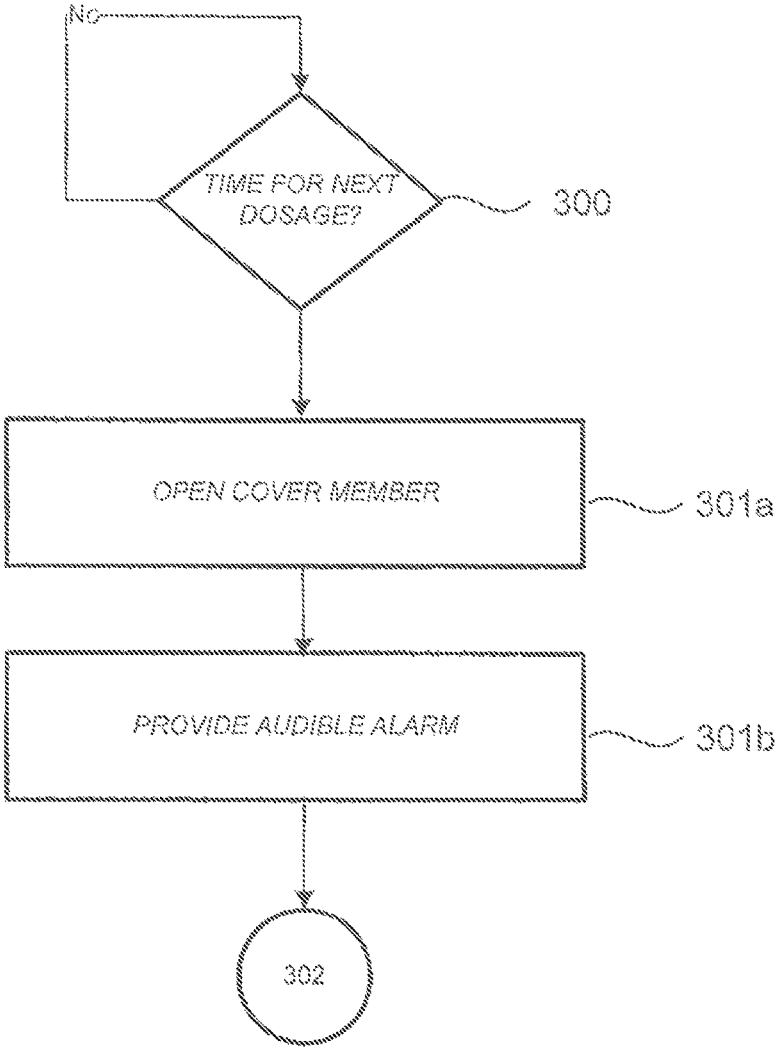
FIG. 3*c* is a flow diagram showing further steps which may precede the method steps outlined in FIGS. 3*a* and 3*b*.

In one embodiment, the method steps of FIGS. 3*a* and 3*b* are preceded by the steps of FIG. 3*c* controlled by control unit 106 which has been pre-programmed with personalised medication data including patient dosage regimes. In this embodiment, control unit 106 includes a clock and continuously polls to determine whether a medication dosage is due (step 300). If a dosage is due, in a step 301*a* control unit actuates cover member 116 to open the apparatus and in a step 301*b* provides an audible alarm through loudspeaker 130 to indicate that medication is due. The user responds by providing a receptacle containing liquid and one or more tablets to be disintegrated (step 302) and loads the receptacle into the sonotrode ring (step 304) according to the method of FIG. 3*a* or 3*b*.

Figure 4A:
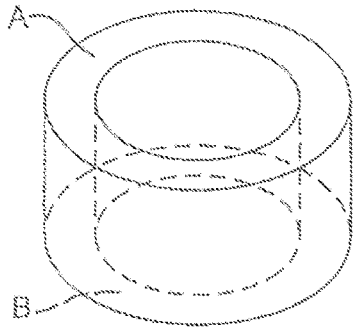
FIGS. 4*a* to 4*f* provide perspective and cross-sectional views of various embodiments of an annular coupling element according to the invention.
Figure 4B:
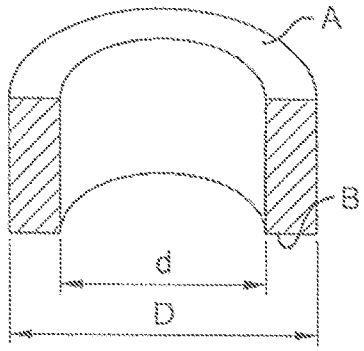

Referring now to FIGS. 4*a* to 4*f*, there are shown alternative forms of a sonotrode in both perspective and cross sectional views, according to embodiments of the invention. FIGS. 4*a* and 4*b* show a basic sonotrode, having constant wall thickness from one edge A to opposing edge B. For apparatus operating at a resonant frequency of about 42 kHz and using Aluminium (having sound velocity of approximately 4877 $ms^{-1}$) as the sonotrode material it is preferable that the sonotrode has a mean diameter of about 40 mm and a length from A to B of approximately 26 mm. Thus, an internal diameter d of approximately 30 mm and an external diameter D of approximately 50 mm would suffice for this embodiment. Other materials which may be used for the sonotrode include e.g. Titanium or materials with higher tensile strength. The sound velocity of the material will affect the dimensions of the sonotrode.

Figure 4C:
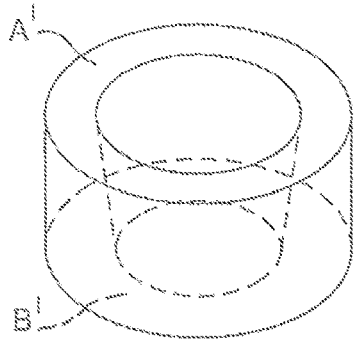
Figure 4D:
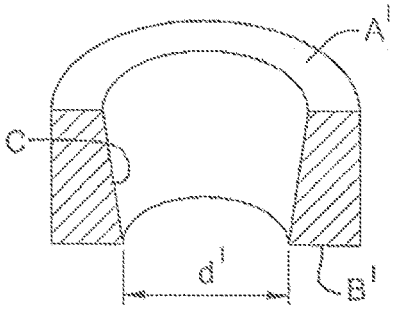

FIGS. 4*c* and 4*d* show a preferred form of a sonotrode according to an embodiment of the invention, where the sonotrode has a cross sectional profile configured to improve ultrasonic energy transference to the receptacle contents. In FIG. 4*c* although the sonotrode length from A' to B' is the same as in FIGS. 4*a*, 4*b* and the external diameter is constant, the internal diameter increases toward a first edge, A' forming a taper in the sonotrode cross section. In a preferred embodiment, the taper on the internal wall of the sonotrode is matched to the angle of the external wall of the coupling zone E of the receptacle 502 (see FIGS. 5*a*, 5*b*) to achieve sufficient coupling between the external wall of the receptacle and the internal wall of the sonotrode along contact surface C. The taper also acts as a guide for receiving the receptacle.

Finite Element Analysis (FEA) may be used with a mathematical model of the sonotrode to establish modes of distortion which occur within the sonotrode and which are in turn coupled to the receptacle. By using FEA, parameters such as sonotrode diameter and wall thickness (and shape) can be altered and the changing effect on resonance can be modelled. Modes of distortion which have been observed by FEA include radial distortion where there is expansion and contraction of the sonotrode and torsional distortion where sections of the sonotrode rotate about an axis perpendicular to the transducer.

Sonotrode distortions may occur with or without variation around the circumference of the sonotrode. Where radial distortion occurs with variation around the sonotrode, the shape becomes significantly distorted and in one model, adopts a hexagonal shape instead of a substantially circular annulus. In another model the radial distortion causes the sonotrode to resemble a square shape. Where there is radial distortion but without variance around the periphery, the overall effect is a linear shifting of the sonotrode along the axis of the applied ultrasound signal (i.e. along the axis of the ultrasound transducer) causing ultrasonic vibration of the receptacle contents along an axis in line with the ultrasound transducer. Where torsional distortion occurs with variation around the sonotrode, there is twisting of the sonotrode. Where there is torsional distortion without variation, the sonotrode appears inverted. This becomes more important when a contoured sonotrode is used. That is, a sonotrode having graduated or varying wall thickness.

Thus, the geometry of the sonotrode has considerable impact on the distribution of stresses during application of the ultrasound energy to the receptacle. In general, it has been found that radial modes of distortion are highly sensitive to changes in sonotrode diameter, whereas torsional modes are less so. In contrast, radial modes of distortion tend to be less sensitive to sonotrode length (i.e. the dimension from edge A to edge B) than to diameter, but some torsional modes are sensitive to length.

FEA performed on a model of the tapered sonotrode represented in FIGS. 4*c,d* reveals that there is non-uniform distortion of the ring from edge-to-edge (i.e. there is uneven radial motion). This could lead to losses at the interface and clamping points of the system. It is hypothesised that these losses could be minimised by maintaining relatively constant radial amplitude across the outside surface. One approach to achieving this is to provide tapers toward both edges A and B of the sonotrode. One such embodiment is illustrated in FIGS. 4*e,f*.

Figure 4E:
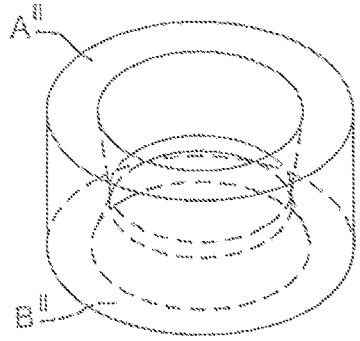

In the embodiment illustrated in FIGS. 4*e,f* the sonotrode has a length L of approximately 26 mm. The contact surface C which contacts the external wall of the receptacle has a taper toward first edge A" which matches the external wall angle of the receptacle which, in a preferred embodiment, includes a taper of about 7 degrees (see FIGS. 5*a,b*). The taper toward second edge B" is approximately 20 degrees. The total length of contact surfaces C' and C is approximately 17 mm while the length of balance surface S is approximately 8.5 mm. In this embodiment, the inside diameter d" of the sonotrode has been selected to be approximately 29 mm. The external diameter D has been determined, based on the material properties of the sonotrode, to be approximately 49 mm.

Figure 4F:
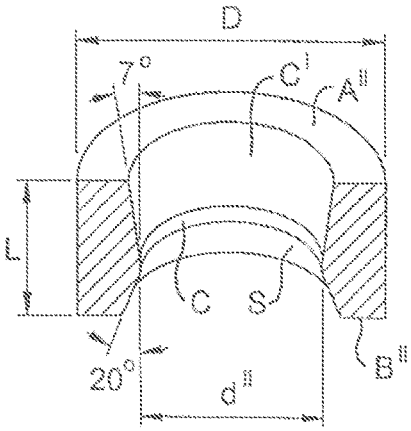

A FEA stress plot for this embodiment shows maximum stresses within the sonotrode occurring toward the inside wall and focussing at the area of smallest internal diameter designated C in FIG. 4*f* which maximises ultrasonic energy transference to the receptacle contents. This dual-taper design also achieves more even distribution of material along the transducer axis possibly removing potential for amplitude variations with axial position on the contact surface with the amplifier and ensures there is ring resonance in resonance mode with uniform radial motion on the outside surface. Inner wall portion C has no taper and prevents the receptacle from becoming wedged inside the sonotrode.

Selection of the sonotrode dimensions is dependent in part on the material properties of the sonotrode and other components of the system, as well as the couplings between functional elements of the apparatus. Given the uncertainties surrounding material properties of various elements, in one embodiment, the sonotrode may be manufactured oversize e.g. with an external diameter of approximately 52 mm, and "tuned" down gradually until the desired resonant frequency is reached as would be understood by a person skilled in the relevant art. Other design approaches which may be adopted to maximise efficiency include decreasing the working frequency, increasing signal boosting (i.e. amplification) and changing the sonotrode material to one with higher sound transmission velocity characteristics.

Figure 5A:
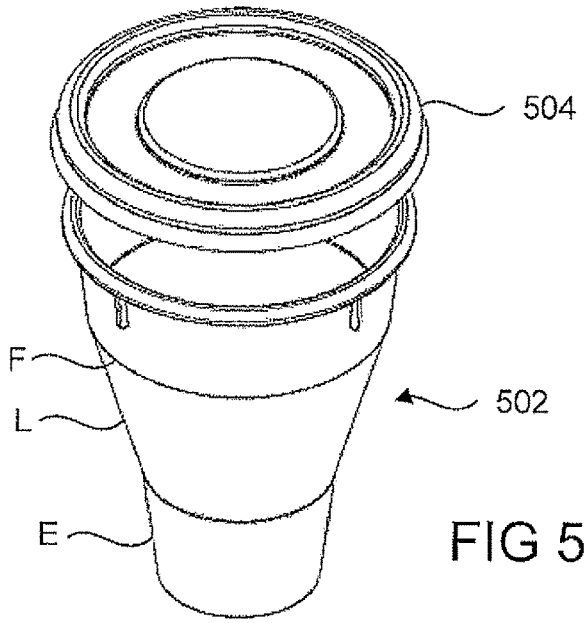
FIGS. 5*a* and 5*b* are perspective and cross-sectional views of a receptacle with lid for use with embodiments of the invention.
Figure 5B:
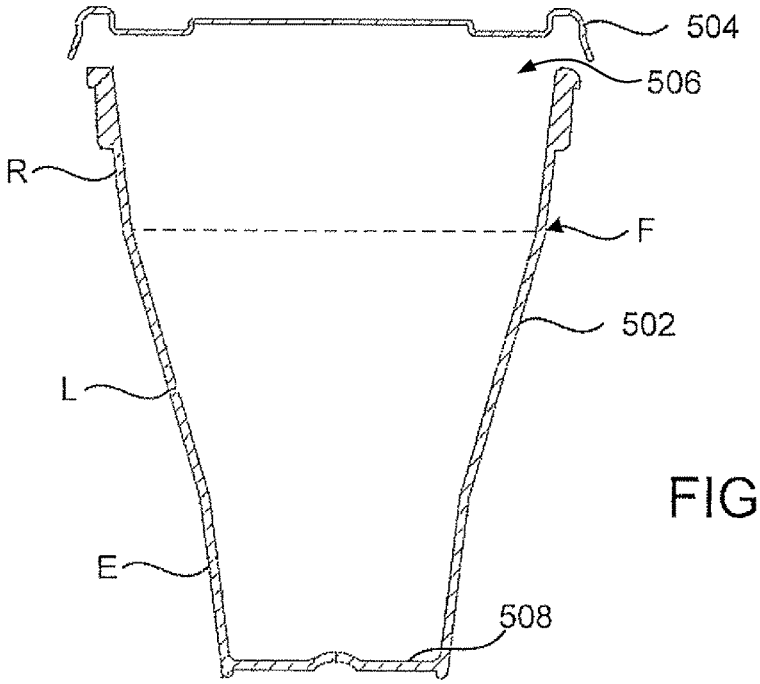

FIGS. 5*a* and 5*b* are schematic illustrations of a receptacle 120 for use with embodiments of the present invention, in perspective and cross-sectional views respectively. The receptacle 120 preferably includes a body 502 and removable lid 504 for sealingly closing mouth 506 of the receptacle. Although not essential, application of a lid prevents accidental spillage of liquid from the receptacle during disintegration and also during transfer of the receptacle containing the liquid and tablet to and from the apparatus.

The receptacle dimensions are selected in conjunction with the sonotrode diameter to optimise design and performance and also useability of both the apparatus and the receptacle. The receptacle includes a region E having external dimensions sufficient to be received by and couple with sonotrode 112. In a preferred embodiment, external walls of the receptacle in region E are tapered to maximise ultrasound energy transference from the sonotrode to the receptacle contents as is illustrated in FIGS. 5*a* and 5*b*.

In the illustrated embodiment, region E has external walls tapering inwardly toward the receptacle floor, at approximately 7 degrees from a vertical axis. This matches the internal taper of the sonotrode rings illustrated in FIGS. 4*c* to 4*f*. In such arrangement, the region E is configured to couple with contact surface C (and C') of the sonotrode ring. Thus in use, ultrasonic energy is transferred through the receptacle wall to the liquid contained within the receptacle, where the energy propagates to the tablet causing disintegration.

It is to be understood that the angled wall in region E may continue toward the base of the receptacle, forming an apex. However, such a design may be impractical as disintegrated tablet particles may accumulate in the apex affecting disintegration efficiency and causing difficulty in removal of the disintegrated tablet from the receptacle for drinking. Furthermore, an apical receptacle base is impractical as it precludes resting the receptacle on a bench top, tray or other flat surface. It is more desirable to provide a substantially flat receptacle floor 508.

Although the wall angle in region E may continue toward the receptacle opening, in a preferred embodiment the receptacle walls are contoured so as to provide an opening diameter which is amenable to drinking the liquid directly from the receptacle. Such a diameter may be from e.g. 40 to 70 mm and more preferably is between 55 and 65 mm. An opening internal diameter of about 58 mm is particularly suitable when combined with a receptacle having a total height of approximately 74 mm, a base external diameter of approximately 33 mm and a wall thickness of about 3 mm. In a preferred design, the receptacle includes a wall region L meeting another wall region R at line F which extends around the external wall of the receptacle. The line F indicates a fill line to which liquid (e.g. water) is added to the receptacle prior to loading into the apparatus. In one preferred embodiment, filing the receptacle to fill line F accommodates a volume of approximately 40 ml of liquid. A plurality of fill lines may be provided to indicate a range of fill volumes e.g. 40 ml, 50 ml and 60 ml.

In one embodiment, the liquid is added to the receptacle to fill line F manually by the user. In another embodiment, the apparatus may include a reservoir containing liquid and a pump controlled by control unit 106 which fills the receptacle with a suitable volume when a receptacle is loaded into the apparatus. In one embodiment, the apparatus includes a waste in the housing for egress of unwanted fluid from the apparatus which may be the result of spillage or leakage. Fluid from the drain may accumulate e.g. in a removable tray or reservoir or may be diverted into a sink waste, drain or the like.

FIG. 6*a* shows a side view of a receptacle securing device 600 that may provide an alternative to cover member 116 and/or force actuator 126 shown in FIG. 1. Receptacle securing device 600 includes a flared body 601 adapted to be received in mouth 506 of receptacle 120. The purpose of flared body 601 is to provide better lateral location or alignment for receptacle 120 inside housing 102 (approximate location or alignment of the receptacle is provided by opening 122 in housing 102).

Receptacle securing device 600 includes a plurality of springs 602-604 adapted to interface with cover member 116. The purpose of spring 602-604 is to provide additional downward force onto receptacle 120 as this helps to ensure good coupling of ultrasonic energy between floor 508 of receptacle 120 and annular coupling element 112.

FIGS. 6*b* and 6*c* are side and perspective views of a receptacle securing device 605 that adds a mechanical agitator 606 to device 600 of FIG. 6*a*. Mechanical agitator 606 comprises a stainless steel hook adapted to agitate or stir dissolved contents in receptacle 120. Agitator 606 is driven via direct coupled stepper motor 607 shown inside a hub or pocket of body 601. Agitator 606 may be actuated to more thoroughly disperse or dissolve disintegrated contents such as medication in receptacle 120 and/or minimize aggregation of the disintegrated contents.

The receptacle containing a tablet may be loaded into the apparatus manually. Alternatively, the apparatus may be fully automated, automatically loading the receptacle into the sonotrode ring and filling with the required volume of liquid. The apparatus may additionally be fitted with a secure container holding tablets or other medication units to be loaded into the receptacle automatically e.g. according to a personalised medication regime pre-programmed into the control unit, or upon receiving input from a user via inputs 132.

In one embodiment, the apparatus is suitable for use in the home, e.g. on a kitchen or bathroom bench. The apparatus may be powered from a mains power outlet or it may be embodied in a mobile unit operated by battery. A battery powered unit may be suitable for use in environments where mobility is desirable and in such arrangement it is preferred that the battery is rechargeable by connecting the apparatus to mains power when it is not in use although replaceable or interchangeable, rechargeable batteries may be employed.

Advantageously, the present invention provides a dry-coupled ultrasound system for disintegration of solid medication, pharmaceutical or neutraceutical preparation in the form of a tablet, capsule, caplet, pill or the like. Because a dry-coupling approach is adopted, there is no fluid coupling system required internal to the apparatus and there is no insertion of the sonotrode into the receptacle contents. Therefore there is no risk of contamination between uses. In a preferred embodiment the receptacles are disposable so there is no cleaning required whatsoever.

Because the disintegration method involves application of ultrasonic energy having known characteristics, tablets are disintegrated in a controlled and predictable manner. Thus, there is consistency in the size of the particles which result from the disintegration process. This is not the case for mechanical tablet crushing systems which typically adopt manual force to break up the tablet. The special arrangement of the annular coupling element (sonotrode) and cup design can also give rise to improved efficiency over existing tablet crushing methods.

It is to be understood that various modifications, additions and/or alterations may be made to the parts previously described without departing from the ambit of the present invention as defined in the claims appended hereto.

The invention claimed is:

1. Apparatus for disintegration of a solid in a receptacle containing liquid, the apparatus including a housing containing:

(a) a control unit;

(b) an ultrasound transducer generating ultrasonic energy under control of the control unit; and (c) an annular coupling element in communication with the ultrasound transducer and configured to receive the receptacle for transfer of the ultrasonic energy to the receptacle contents;

wherein the control unit is configured to control the ultrasound transducer to operate in a swept frequency mode in which frequency of the ultrasonic energy fluctuates between a resonant frequency and one or more no-resonant frequencies, wherein in use, the ultrasonic energy transferred to the receptacle contents causes disintegration of the solid into the liquid.

2. Apparatus according to claim 1 wherein the resonant frequency is from 40 to 45 kHz and the non-resonant frequencies are ±2 kHz relative to the resonant frequency, and wherein the swept frequency mode is one or more of: cyclical; random; and dynamically controlled by the control unit based on one or more sensor inputs.

3. Apparatus according to claim 1 wherein the annular coupling element is configured to distort, as a result of application of the ultrasonic energy, in one or more modes of distortion selected from a group including: radial and torsional distortion.

4. Apparatus according to claim 1 wherein the control unit is configured to determine a frequency of the ultrasonic energy being optimal for disintegration of the solid and to control the ultrasound transducer to generate the ultrasonic energy at the optimal frequency.

5. Apparatus according to claim 1 wherein the annular coupling element has an internal annular surface having a first taper toward a first edge and a second taper toward a second edge opposing the first edge.

6. Apparatus according to claim 5 wherein the internal annular surface of the annular coupling element includes a contact region configured to contact an external wall of the receptacle and transfer the ultrasonic energy to the receptacle and its contents.

7. Apparatus according to claim 1 including a force actuator configured to apply a force to the receptacle to enhance coupling between the receptacle and the annular coupling element, and further including a cover member for closing an opening in the receptacle and incorporating the force actuator, wherein the cover member is operable from an open configuration to a closed configuration in two stages and wherein the cover member includes a mechanical agitator.

8. Apparatus according to claim 1 further including cooling means for maintaining temperature of the apparatus and/or the receptacle contents in an acceptable range during operation of the apparatus.

9. Apparatus according to claim 1, when combined with the receptacle, the receptacle including an external wall profile configured to engage a contact region on an internal surface of the annular coupling element, the receptacle further including a marking to indicate a fill level for a liquid added to the receptacle, and including a lid for sealingly closing the receptacle.

10. Apparatus according to claim 1, wherein the apparatus includes a mechanical agitator.

11. Apparatus according to claim 10, wherein the mechanical agitator includes a steel hook driven via a stepper motor.

12. A method for disintegrating a solid in a receptacle including the steps of:

(a) providing a volume of liquid together with the solid in the receptacle;

(b) loading the receptacle containing the solid and liquid into an annular coupling element coupling the receptacle to an ultrasonic energy source;

(c) activating the ultrasonic energy source to apply ultrasonic energy to the annular coupling element for a time sufficient to cause disintegration of the solid in the receptacle; and (d) fluctuating the frequency of the ultrasonic energy between a resonant frequency and one or more non-resonant frequencies.

13. A method according to claim 12 wherein the resonant frequency is from 40 to 45 kHz and the non-resonant frequencies are ±2 kHz relative to the resonant frequency.

14. A method according to claim 12 including the step of applying a coupling force to the receptacle in a direction toward the annular coupling element to enhance coupling between the receptacle and the annular coupling element.

15. A method according to claim 12 including the step of providing one or more of an audible and a visible cue to indicate that the solid in the receptacle has been disintegrated within the liquid.

16. A method according to claim 12 including the step of adding a flavouring additive to the liquid.

17. A method according to claim 12, wherein the method includes mechanically agitating the solid.

* * * * *